United States Patent [19]

Nyström

[11] 3,940,933

[45] Mar. 2, 1976

[54] METHOD FOR REGULATING THE OUTPUT OF A STIRLING-TYPE HOT GAS ENGINE AND DEVICE FOR THE SAME

[75] Inventor: Per Henrik Gösta Nyström, Borensberg, Sweden

[73] Assignee: Forenade Fabriksverken, Sweden

[22] Filed: Oct. 17, 1974

[21] Appl. No.: 515,718

[30] Foreign Application Priority Data

Oct. 19, 1973 Sweden ..... 7314258

[52] U.S. Cl. ..... 60/522

[51] Int. Cl.[2] ..... F02G 1/04; F02G 1/06

[58] Field of Search ..... 60/521, 522

[56] References Cited

UNITED STATES PATENTS 3,817,035 6/1974 Hakansson ..... 60/521

3,859,793 1/1975 Jansson ..... 60/521

*Primary Examiner*—Allen M. Ostrager

*Attorney, Agent, or Firm*—Hill, Gross, Simpson, Van Santen, Steadman, Chiara & Simpson

[57] ABSTRACT

Commercial exploitation of the closed-cycle Stirling engine has been delayed because of inherent difficulties in controlling the engine output instantaneously. The disclosed invention presents a method and a device for intermittent power control of a Stirling engine by alternately connecting and disconnecting a separate dead space to the engine gas circuit. The control cycle includes a multiple of engine revolutions and is independent of the engine speed.

10 Claims, 3 Drawing Figures

Figure 1:
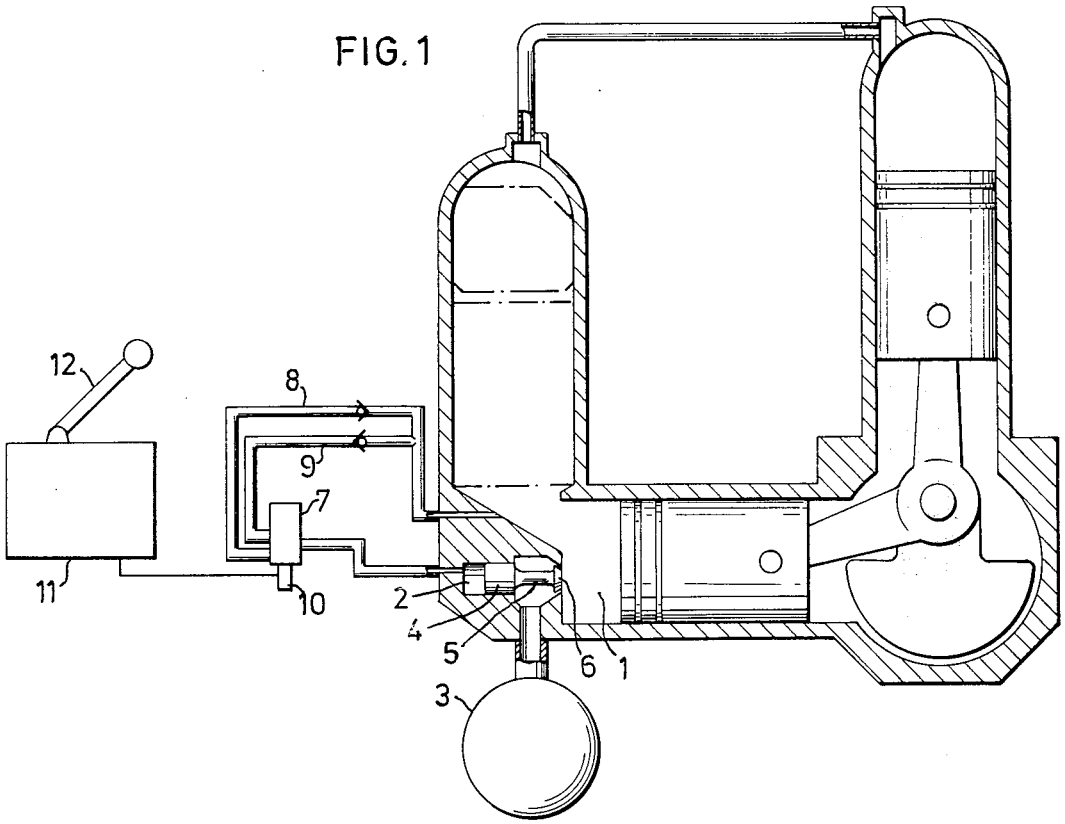

P
P2
P4
P3
P1
t
t1
t2
t3
1
2
3
4
5
6
7
8
9
10
11
12
13
14
15

METHOD FOR REGULATING THE OUTPUT OF A STIRLING-TYPE HOT GAS ENGINE AND DEVICE FOR THE SAME

FIELD OF THE INVENTION

This invention pertains to the control of a hot gas engine of the stirling type.

PRIOR ART

The Stirling engine operates with a closed work cycle in which one and the same amount of working gas is transferred between various chambers in order to effect the various phases of the cycle. Compared to the open work cycle of the Otto and Diesel cycle engines in which the output can be instantaneously changed by altering the flow of working gas from and to the atmosphere, instantaneously regulating the engine output in the closed Stirling cycle involves certain difficulties.

One practicable and successful method is to regulate the output by means of changing the so-called engine dead space, i.e. the volume which remains for the working gas at maximum compression during the work cycle.

Various methods and devices for such regulation of the dead space are known.

The first involves infinitely variable dead space from a maximum value which, at the prevailing highest gas temperature, gives the lowest output and a minimum value which gives corresponding highest output or full power. The device for this purpose comprises essentially a cylinder with a piston connected to the engine gas circuit, said piston being displaceable towards its upper dead point when the output is to be increased so that the working gas therein is displaced from the dead space cylinder to the engine internal gas circuit. This increases the engine pressure amplitude which instantaneously results in an increase in output. In spite of its fundamental value the method and device imply increased practical difficulties and engine costs with sealing, control force and control of the piston position.

The second involves a number of dead spaces which can be individually connected to the engine gas circuit. The device then consists of delimited chambers, whose volumes are appropriately related to the engine internal dead space, e.g. $2^{-n}$ where $n$ is an integer. By means of two-way valves the number of chambers connected to the gas circuit can be changed so that the dead space and hence the pressure amplitude of the working gas varies by sufficiently small stages, even with a moderate number of dead space chambers, for example three or four. Even if this type of step-wise power control does not imply any true disadvantage, it has been found that the valve arrangement for opening and closing of the desired combinations of the various dead space chambers is complex and costly if it is to operate with satisfactory reliability.

A third known method is to employ a single dead space, sufficiently large for the desired minimum output, which for each work cycle of the Stirling engine is connected to the gas circuit, starting at the beginning of the work cycle at mean gas pressure, by means of a two-way valve. The dead space is then shut off from the gas circuit by the valve after a part of the compression stroke has been carried out. The method implies that the pressure amplitude of each work cycle is lowered below the maximum value in a pre-set relation to the part of the compression stroke when the gas circuit is connected to the dead space. This makes it possible to steplessly control the engine output between the two extreme values when the dead space is constantly disconnected and connected, respectively. The practical device for realizing this method meets with great difficulties, however, owing primarily to the therewith associated demands for extremely fast opening and closing of the valve at the desired time in the work cycle at fairly high frequency, 50 Hz being a normal value. At this value, the valve is required to open or close completely within a few milliseconds of the delimited interval of 1/100 of a second. This is practically unfeasible since both the mass and the movement of the valve and control device are considerable and the control force is limited.

Errors in timing and period for opening or closing the valve involve throttle losses in the engine working gas and thereby decreased efficiency.

SUMMARY OF THE INVENTION

The present invention relates to a method for regulating the output of engines of the Stirling type by means of intermittant connection and disconnection of a single dead space of suitable volume having a two-way valve controlled by a pilot valve during a space of time comprising respectively a plurality of engine work cycles and portions thereof.

In the method according to the invention, a control cycle period suitable for the engine working frequency is selected, for example 1/10 to 2/10 second, and the two-way valve between the engine gas circuit and the dead space is held closed during a part of this period and it is held open during the remaining part of the period. In this way the engine will, in the same order, first carry out a number of work cycles with high pressure amplitude and then a number of work cycles with low pressure amplitude, after which the control cycle is repeated. The control frequency and the crankshaft frequency are not required to have a determined relation to one another, nor need they be synchronized.

The consequence of the foregoing is that the engine during the short period of the control cycle alternately delivers full output and idling output in such proportions as are determined by the pre-set modulation of the valve position. The extreme values naturally imply full output for a closed valve during the entire control period and idling output for an open valve during the entire control period, respectively.

If the engine operates under constant load its speed will thus increase during the earlier portion of the control cycle and will decrease during the later portion. Speed variations during the control period will therewith depend, among other things, on the composite rotary moment of inertia and will under all normal applications be negligible.

If increased output is desired, the closed-valve portion of the control cycle is increased and the open-valve portion is decreased. If reduced output is desired, the open-valve portion is instead increased.

Because the control cycle and the engine work cycle have only a conveniently chosen, approximate frequency relationship but do not include regulating of the control cycle in phase with the work cycle, it occurs, of course, as a rule that the valve opens and closes, respectively, out of phase with the work cycle. As noted above, this implies decreased efficiency. However, this decrease is negligible since, for example, of 5–10 work cycles with a regulation cycle thereof, only two are disturbed, one for full output and one for idling output. This also results in practicably moderate demands on the valve function, although rapid opening and closing are naturally still desirable.

The invention also concerns a device for effecting the method. In a preferable embodiment the device comprises a dead space chamber connected to the engine gas circuit via a two-way valve, said dead space chamber being sufficiently large to render the desired idling power. The two-way valve is adapted to hold either the open or closed position, wherewith throttle losses via the valve in the open position are small. When the valve is open the pressure in the dead space varies essentially with that in the engine gas circuit. When the valve is closed the pressure prevailing in the dead space equals that in the engine gas circuit at the closing instant.

For opening and closing of the two-way valve, the valve stem is rigidly connected to a piston in a cylinder, which is connected by a duct to a three-way valve or pilot valve, preferably controlled by an electromagnet.

The pilot valve is connected to the engine internal gas circuit by two branch ducts, each containing a check valve. Via the check valves the branch ducts will contain gas at the highest and lowest pressure, respectively, in the engine gas circuit. Either branch duct can be connected to the two-way valve cylinder by means of the magnetic valve, whereupon the resulting force on the two-way valve cylinder either opens or closes the valve. By appropriately dimensioning the piston surface and the valve surface, opening and closing of the valve take place sufficiently fast.

An electronic pulse-time modulator can be employed for control of the position of the magnetic valve, by means of which in a wellknown manner the entire control cycle period can be delimited as well as the portion of the control cycle when the magnetic valve connects the branch duct which leaves the two-way valve open. During operation of the engine, engine power is regulated from its highest value towards its lowest value by increasing this portion, i.e. by increasing the ratio open portion/control period. Regulation involves then essentially the positioning of a control, for example in the form of a knob, a lever or a pedal, which influences the pulse modulator portion or ratio for open valve.

If the regulation particularly concerns maintaining the engine speed constant at a certain value, this can also be accomplished by known means by comparing electric impulses from an engine-shaft driven tachometer with the pre-set value for the speed in a summator and by increasing or decreasing the pulse time for holding the valve open in accordance with the measured difference.

Another simple device for holding the speed constant in a Stirling engine according to the invention comprises an electro-mechanical device with a dc-source to the magnetic valve and a breaker comprising an inertial mass on a leaf spring and an adjusting screw, whereby the speed is adjusted.

On the drawings:

The invention is described below with reference to the attached drawings, in which FIG. 1 shows a Stirling engine fitted with a dead space connection for optional output control according to the invention, FIG. 2 a Stirling engine with output control according to FIG. 1 and a device for maintaining constant speed and FIG. 3 a diagram of the pressure in the engine gas circuit when the dead space is connected and disconnected intermittently for output control according to the invention.

As shown on the drawings:

The gas circuit in the Stirling engine 1 in FIG. 1 can by means of a two-way valve 2 be connected to a suitably large vessel having a dead space 3. The valve 2 opens between the gas circuit and the dead space 3 when a valve head 6 is lifted from its seat by a stem 5 connected to a piston 4 in the valve 2. The free surface of the piston 4 is considerably larger than the valve head 6 surface. The piston 4 is actuated via a duct by the gas pressure in a three-way valve or pilot valve 7. The pilot valve 7 is connected to the gas circuit in the engine 1 through two branch ducts 8 and 9 having two divergently directed check valves. The highest or alternatively lowest gas pressure occurring in the engine 1 gas circuit can thus be made to act on the piston 4 in the two-way valve 2 by means of an electromagnet or magnetic relay 10 in the pilot valve 7. When the highest gas pressure from the branch duct 8 acts on the piston 4 the valve head 6 is closed against the seat and the dead space 3 is disconnected from the gas circuit in the engine 1. When branch duct 9 with the lowest gas pressure is instead connected to act on the piston 4, valve 2 opens and connects the dead space 3 to the engine 1 gas circuit. Because the piston 4 is considerably larger than the valve head 6 the gas pressure forces on piston 4 in both cases are so large that the valve head 6 opens or closes instantaneously.

The magnet 10 is fed by a source of current not shown through a pulse time modulator 11, which is furnished with a control 12 which can be designed as, for example a knob, a lever or a pedal. According to the setting of the control 12, the magnetic relay 10 via the branch ducts 8 and 9 opens the valve 2 during the entire control cycle period, a portion of the control cycle period or during none of the period.

Figures 2, 3:
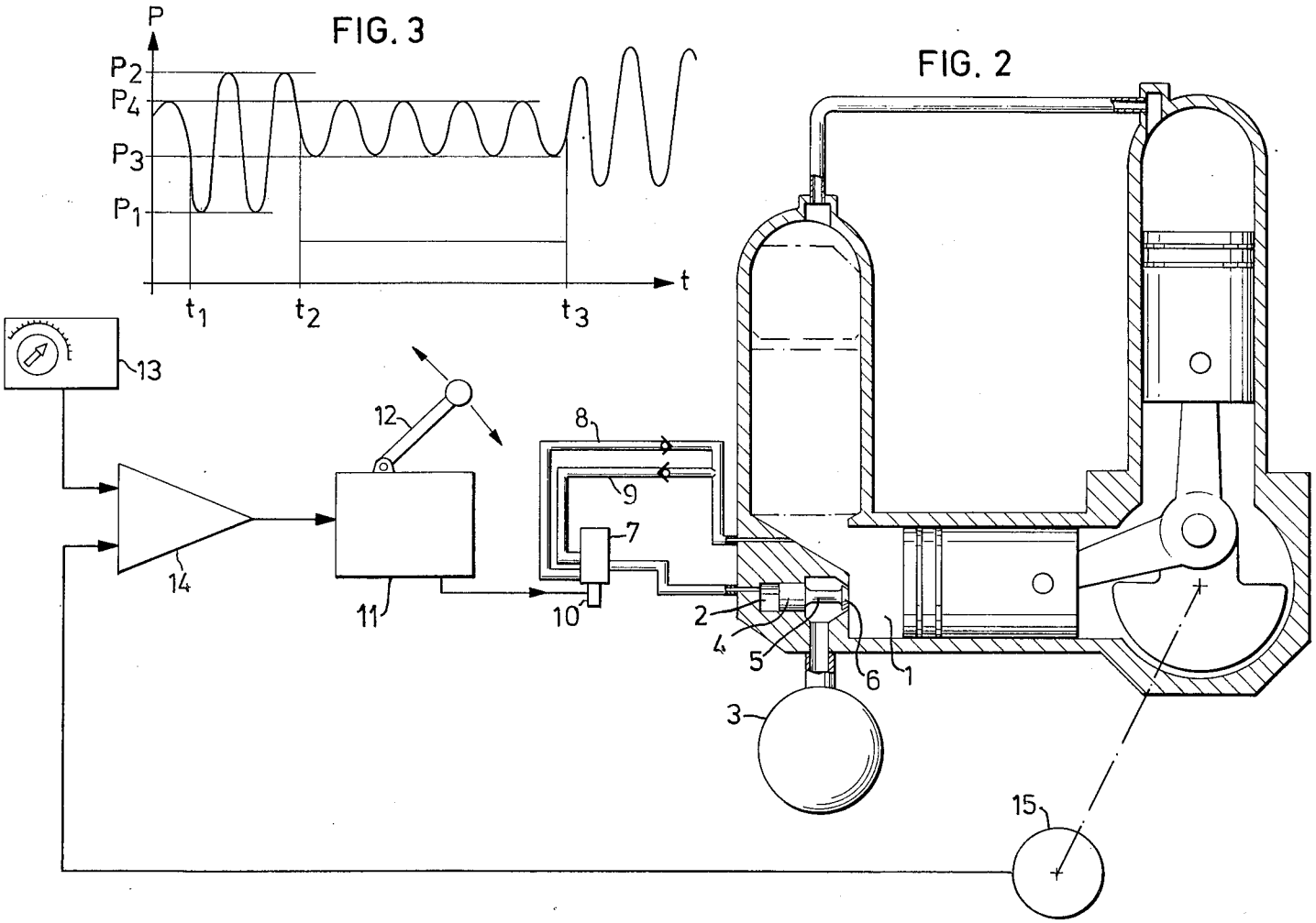

FIG. 2 shows the same engine 1 with the same device for control of the output by means of intermittent dead space connection as in FIG. 1, though not necessarily furnished with the control 12. For maintenance of an approximately constant, desired speed of the engine 1 there is instead a speed setting device 13, which is connected to a summator 14, which in turn controls the pulse time in the pulse time modulator 11, which by previously described means controls the magnetic valve 10 and therewith the valve 2.

A tachometer generator 15, which is electrically connected to the summator 14 and which is mechanically connected to the engine shaft, allows comparison of actual versus pre-set speed. Because of the intermittent adjustment the engine speed will, under all operating conditions, vary during the control time cycle, the variations depending, among other things, on the inertial mass connected to the engine and the instantaneous load on the engine. During the portion of the control cycle when the valve 2 is open, the engine speed will generally decrease while during the remainder of the control cycle it will increase. As long as the summator 14 senses that the speed from the tachometer generator 15 is correct no pulse time changes in the pulse time generator 11 will take place.

Long term practical tests with the above-described method and device clearly show that the control cycle being unrelated to the engine cycle frequency and cycle phase does not involve any difficulties nor does it imply reduction of engine efficiency if only closing and opening times of the valve 2 is short in relation to the work cycle period. This is achieved with the described device.

FIG. 3 shows diagrammatically how the method according to the invention affects the gas pressure in the engine 1 gas circuit. The pressure $p$ in the gas circuit is shown on the vertical axis, and time $t$ along the horizontal axis.

In the left hand part of the diagram the valve 2 is open, i.e. the dead space 3 is connected and the pressure amplitude in the engine 1 gas circuit is therefore small. At $t_1$ the valve 2 closes off the dead space 3 from the gas circuit after which the engine work cycle continues several revolutions with reduced dead space and thereof resulting higher pressure amplitude $p_2$–$p_1$. At $t_2$ the valve 2 again opens for connecting of the dead space 3 to the gas circuit, by means of which the pressure amplitude falls to $p_4$–$p_3$. This pressure amplitude is held until the valve 2 at $t_3$ again closes off the dead space 3 from the gas circuit, so that the pressure amplitude again increases.

The time $t_3$–$t_1$ is the control cycle period and is thus equal to the inverse value of the pulse time modulator carrier frequency. For a given engine having a specific purpose this period is fixed and has a value corresponding to approximately ten work cycles at the normal speed of the engine. On the other hand no connection need exist between the time points $t_1$, $t_3$ and any special pressure value in the work cycle.

The portion $t_3$–$t_2$ when the valve 2 is open can be called pulse time. As is clear from the diagram, $t_3$ occurs at an arbitrary pressure within the interval $p_4$–$p_3$, for which reason the mean pressure during the work cycles where the valve 2 is closed differs as a rule from the mean pressure with the valve 2 open.

If the summator 14 in the same way senses that the desired value of speed has been exceeded, it emits a signal to the pulse time modulator 11 to increase the pulse time, thus holding the valve 2 open, and when the desired value has been underpassed to decrease the pulse time. The actual speed of the engine can thereby be held at the desired value within an allowed margin.

What I claim is:

1. A method for controlling the power of a hot gas engine of the Stirling type having a dead space separated from the engine internal gas circuit, comprising:

periodically connecting the dead space to the gas circuit and disconnecting the dead space from the gas circuit for a combined period of time comprising one control cycle of constant duration independent of engine speed, whereby gas circuit pressure amplitude respectively decreases and increases.

2. A method according to claim 1 in which the duration of said control cycle is that of a plurality of engine revolutions.

3. A method according to claim 2 in which the duration of the portion of the control cycle in which the dead space is connected to the gas circuit is steplessly varied within the entire control cycle.

4. A method according to claim 1 in which the duration of the portion of the control cycle in which the dead space is connected to the gas circuit is steplessly varied within the entire control cycle.

5. A device for controlling the power of a hot gas engine of the Stirling type having dead space separated from the engine internal gas circuit, comprising:

a. electrically controlled valve means adapted to connect the dead space to the gas circuit; and b. a pulse time modulator having an output terminal connected to said electrically controlled valve means, said modulator having a constant duration cycle independent of the engine, a portion of which cycle is regulable in duration and which portion energizes said valve means.

6. A device according to claim 5 including a control connected to said pulse time modulator for regulating the duration of said portion of said control cycle.

7. A device according to claim 5 including:

a. a tachometer generator adapted to be mechanically driven by the engine;

b. a speed selecting device settable to a desired engine speed; and c. an electronic summator connected to receive speed-dependent signals from said tachometer generator and said speed selecting device, said summator being operative to compare such signals and to emit a corrective control signal, and having a connection to said pulse time modulator for said control signal to regulate the duration of said portion of said cycle;

whereby a desired engine speed is maintained.

8. A device according to claim 5 in which said valve means includes:

a. a two-way valve connecting the dead space to the gas circuit;

b. an electrically controlled three-way pilot valve;

c. a pair of gas ducts having oppositely facing check-valves therein connected to said pilot valve and adapted to be connected to the gas circuit; and d. a third gas duct interconnecting said valves.

9. A device according to claim 8 in which:

a. a first of said pair of gas ducts is connected to said two-way valve by said pilot valve during said portion of said cycle; and b. the other of said pair of gas ducts is connected to said two-way valve by said pilot valve during the remainder of said cycle.

10. A device according to claim 9 including: a displaceable piston forming a part of said two-way valve, said piston being responsive to the different gas pressures in said ducts and movable to a first position in which said two-way valve is open and a second position in which said two-way valve is closed.

* * * * *